US007093857B2

(12) United States Patent
Martin

(10) Patent No.: US 7,093,857 B2
(45) **Date of Patent: *Aug. 22, 2006**

(54) BIRTHDAY CALENDAR

(76) Inventor: Judy A. Martin, P.O. Box 398, Calhoun, MS (US) 38916

( * ) Notice: Subject to any disclaimer, the term of this patent is extended or adjusted under 35 U.S.C. 154(b) by 315 days.

This patent is subject to a terminal disclaimer.

(21) Appl. No.: 10/760,589

(22) Filed: Jan. 21, 2004

(65) Prior Publication Data

US 2005/0082817 A1 Apr. 21, 2005

Related U.S. Application Data

(63) Continuation-in-part of application No. 10/685,406, filed on Oct. 16, 2003.

(51) Int. Cl.
*B42D 5/04* (2006.01)
*B42D 15/00* (2006.01)

(52) U.S. Cl. ..... 283/2; 283/115; 283/117; 281/39; 40/107; 40/661; 434/408; 19/20; 19/25

(58) Field of Classification Search ..... 283/2, 283/115, 117; 40/107, 661; D19/20, 25; 281/39; 434/408
See application file for complete search history.

(56) References Cited

U.S. PATENT DOCUMENTS

| | | | | |
|---|---|---|---|---|
| 1,153,544 | A | 9/1915 | Eddy | |
| 1,222,612 | A | 4/1917 | Evans | |
| 1,536,429 | A * | 5/1925 | Ferdon | 40/119 |
| 1,710,434 | A | 4/1929 | Shedo | |
| 2,743,011 | A | 4/1956 | Woofter | |
| 2,909,202 | A | 10/1959 | Rock | |
| 4,024,656 | A | 5/1977 | Farnsworth | |
| 4,218,077 | A | 8/1980 | Ember | |
| RE30,959 | E | 6/1982 | Anderson et al. | |
| 4,342,167 | A | 8/1982 | Stanard | |
| 4,345,392 | A | 8/1982 | Cornell | |
| 4,531,314 | A | 7/1985 | Parent et al. | |
| 4,720,123 | A | 1/1988 | Chelius | |
| 4,794,711 | A | 1/1989 | Christensen | |
| 4,852,282 | A * | 8/1989 | Selman | 40/711 |
| 4,902,042 | A | 2/1990 | Rassi | |
| 5,016,917 | A * | 5/1991 | Dubner et al. | 283/4 |
| 5,033,215 | A * | 7/1991 | Newberry et al. | 40/107 |
| 5,062,229 | A | 11/1991 | Werjefelt | |
| 5,195,262 | A * | 3/1993 | Roane | 40/109 |

(Continued)

FOREIGN PATENT DOCUMENTS

| | | |
|---|---|---|
| DE | 31 43 667 | 5/1983 |

(Continued)

*Primary Examiner*—Monica Carter
*Assistant Examiner*—Mark Henderson
(74) *Attorney, Agent, or Firm*—Richard C. Litman

(57) ABSTRACT

The birthday calendar is a dual monthly calendar and twelve-month chart. The calendar is perpetual in that it is not designated for any particular time period. The monthly calendar displays a month, either from a single use calendar or by filling in a month grid disposed on a dry-erase board with erasable ink. The chart is a grid used to permanently record and display birth dates and other annual dates such as anniversaries and holidays. The chart displays columns intersected by rows. The columns are grouped in twelve sets of two having a month column adjacent to a year column. The rows display the dates of each month down the left side of the chart, numbered from 1–31. An event is recorded in the chart by writing the event's name in the appropriate month and date space and the year in the adjacent year space.

17 Claims, 10 Drawing Sheets

U.S. PATENT DOCUMENTS

| | | | | | |
|---|---|---|---|---|---|
| 5,316,342 | A | | 5/1994 | Almo | |
| 5,426,876 | A | | 6/1995 | Jagoe et al. | |
| 5,431,450 | A | | 7/1995 | Coleman | |
| 5,573,404 | A | * | 11/1996 | Stawski, II | 434/238 |
| 5,655,319 | A | * | 8/1997 | LeCompte | 40/107 |
| 5,661,918 | A | * | 9/1997 | Malcolm et al. | 40/107 |
| 5,784,814 | A | | 7/1998 | Capehart | |
| D411,230 | S | * | 6/1999 | Crooks et al. | D19/20 |
| 6,035,565 | A | | 3/2000 | Capehart | |
| 6,138,391 | A | | 10/2000 | Ngan | |
| 6,289,615 | B1 | * | 9/2001 | Kytlica | 40/119 |
| 6,345,457 | B1 | | 2/2002 | Bracken | |
| 2002/0162253 | A1 | | 11/2002 | Whang | |
| 2005/0082816 | A1 | * | 4/2005 | Martin | 283/2 |

FOREIGN PATENT DOCUMENTS

| | | |
|---|---|---|
| DE | 196 48 842 | 8/1997 |
| GB | 2 124 413 | 2/1984 |

* cited by examiner

BIRTHDAY CALENDAR

CROSS-REFERENCE TO RELATED APPLICATION

This application is a continuation-in-part of U.S. patent application Ser. No. 10/685,406, filed Oct. 16, 2003.

BACKGROUND OF THE INVENTION

1. Field of the Invention

The present invention relates to calendars, and more particularly to a dual monthly calendar and a twelve-month chart used to record dates and provide an overall view of events on one page.

2. Description of the Related Art

Remembering birth dates or other recurring occasions can be difficult when several birthdays or events are involved. For example, one not only has to remember important dates of immediate family members, but also of extended family members, such as aunts, uncles, cousins, grandparents, etc. People who rely on memory to recall dates are subject to human error. A better way to recall events is by writing them down on a Using calendars to recall events, however, is not problem-free. For example, many calendars only display one month at a time, so one must flip through the calendar to the other months to see when future events will arise. Also, most calendars are discarded after the calendar year expires, so that events recorded on an expired calendar must be transcribed to a new calendar. In some cases calendars do not provide space for recording events, so important dates must be written on some other reminder document. In either instance, problems exist, such as improper transcription of dates or misplacement of pieces of paper that have information recorded on it. Several calendars have been developed that are perpetual and others have been developed that provide the user with space to record information.

U.S. Pat. No. 2,909,202, issued to Rock on Oct. 20, 1959, describes a calendar for recording important events. The calendar uses blank month sheets that allow the user to fill in the name of the month, the dates of the month and important events in the space provided. After one use, the calendar sheet is discarded. U.S. Pat. No. 4,218,077, issued to Ember on Aug. 19, 1980, describes a blank six-month chart. The device consists of six individual blank month grids on one page used to display and record events for any six-month period.

U.S. Pat. No. 4,794,711, issued to Christensen on Jan. 3, 1989, describes a perpetual calendar that uses memo cards to record important dates and anniversaries. The memo cards are inserted into a calendar that has pockets representing each date of a month. British Patent Number 2,124,413, published on Feb. 15, 1984, describes a perpetual calendar, assembly where memo cards are inserted into numbered date pockets. Month indicating cards and day indicating cards are inserted into month and day pockets, respectively, to display the appropriate month and day of the year. U.S. Pat. No. 5,655,319, issued to LeCompte on Aug. 12, 1997, describes a perpetual recordation calendar that is folded along designated lines to display the appropriate dates for a particular month.

U.S. Pat. No. Re. 30,959, issued to Anderson et al. on Jun. 8, 1982, describes a scheduling board. The board has a number of columns and rows. One column provides space to display a day-date, the other columns provide space to list jobs and to note the progress of the jobs. The day-date column of the scheduling board is shown displaying four five-day workweeks of a month.

Some calendars have been designed to have a tear-away portion for removal of expired calendar dates. U.S. Pat. No. 6,138,391, issued to Ngan on Oct. 31, 2000, describes a calendar. The calendar has a top cover having apertures to display the month, the day of the week and the year on an underlying stack of calendar sheets. The calendar sheets are perforated for easy removal. As the month expires, the sheet is removed from the rest of the calendar. The calendar does not have to be removed from the wall each time a new month comes up nor does the page have to be rotated when using a spiral type multi-page calendar.

German Patent Number 3,143,667, published on May 11, 1983, describes a tear-off calendar having calendar sheets with perforated fields. German Patent Number 19,648,842, published on Aug. 7, 1997, describes a calendar where expired calendar sheets can be torn off and recycled into useful articles such as an envelope.

Many calendars have a plurality of sheets that are bound together into a book or binder. U.S. Pat. No. 5,062,229, issued to Werjefelt on Nov. 5, 1991, describes a postcard calendar. The calendar comprises a plurality of sheets bound together as a binder along one edge. The sheet therefore can be turned to expose the next sheet. The sheet is divided into a first portion and a second portion by a perforated demarcation line that runs across the sheet. The first portion of the sheet displays the calendar indicia and remains attached the binder. The second portion of the sheet displays the postcard and it is detachable. On the rear surface of each sheet, space is provided for writing down important dates, notes or other messages.

U.S. Pat. No. 4,902,042, issued to Rassi on Feb. 20, 1990, describes a calendar. The calendar comprises a number of sheets that are bound together into a book so that when one page is turned the next page is displayed. The calendar sheets are divided into sections, one containing calendar information and the other containing illustration or text. The illustration or text section is the portion bound into a book. The calendar section may be detached from the rest of the book so when the calendar expires the calendar may be converted into and stored as an art, science or photography book for future reference.

U.S. Pat. No. 4,531,314, issued to Parent et al. on Jul. 30, 1985, describes a calendar bound as a book. The calendar month is subdivided into a number of fragments to facilitate overturning, if not complete detachment from the book once the exposed dates expire. Overturning will expose current dates as well as future dates.

U.S. Pat. No. 6,289,615 issued to Kytlica on Sep. 18, 2001, describes a calendar that can double as a photo album. The calendar comprises twelve transparent sleeves that are rotatably bound together along one edge. The sleeves receive inserts such as photos or sheets having calendar indicia. The sleeves have a hole or magnetic tabs to suspend the album from a structure.

Several calendars have been developed to have a support integrated with the calendar. U.S. Pat. No. 4,024,656, issued to Farnsworth on May 24, 1977, describes a greeting card calendar where a single folded card forms a front panel covering a scored back panel. A calendar pad is mounted on the back panel, which can be folded along the score lines into an easel to display the calendar pad.

U.S. Pat. No. 6,345,456, issued to Bracken on Feb. 12, 2002, describes a calendar frame having two spaces to display a picture and a monthly calendar. Monthly sheets of the calendar are attached to and advanced about pivoting pegs, forgoing the need to tear, remove or flip the calendar sheets to display a new month. U.S. Pat. No. 6,035,565, issued on Mar. 14, 2000, and U.S. Pat. No. 5,784,814, issued on Jul. 28, 1998, both to Capehart, describe a calendar display comprising a flat support and a plurality of stacked sheets attached to the support. The support can be manipulated to form a stand to display the calendar.

U.S. patent Publication No. 2002/0162253, published on Nov. 7, 2002, describes a calendar cover that folds on itself to create a slanted display stand for the calendar. The cover also folds into a box to wrap around, retain and conceal the calendar. U.S. Pat. No. 4,342,167, issued to Stanard on Aug. 3, 1982, describes a display calendar. The calendar comprises a multi-sheet paper pad having an upper mounting portion, which can display advertisements, and a lower detachable portion, which displays date sheets for each day of the year.

U.S. Pat. No. 1,153,544, issued to Eddy on September 14, 1915, describes a daily date sign. The sign has a back having indicia such as data or advertisements on the top portion of the back and a hanger strip disposed across the middle of the back to receive and detachably retain a removable daily date pad.

A number of calendars have been designed to removably receive a picture. U.S. Pat. No. 5,426,876, issued to Jagoe et al. on Jun. 27, 1995, describes a calendar photo album. The calendar has a picture holding member on every leaf to permit the user to display photos, pictures, and other graphic works of the user's choice in conjunction with a calendar indicia page. The picture holding member may use adhesive material or may be diagonal slits for inserting photos or a cut out window frame for receiving photos.

U.S. Pat. No. 5,033,215, issued to Newberry et al. on Jul. 23, 1991, describes a calendar apparatus for displaying pictures in conjunction with a calendar. The apparatus comprises a rectangular backing member to hold pictures of varying sizes and friction slide members that permit the pictures to be displayed without disassembling the apparatus. The apparatus permits the user to display pictures of the users choice.

U.S. Pat. No. 2,743,011, issued to Woofter on Apr. 24, 1956, describes a display article. The article is a plastic calendar having a top display portion for holding a picture, illustration or advertisement and a bottom portion for displaying a monthly calendar. The top portion forms a pocket for removably receiving a picture at the top. The bottom portion has a pair of plastic pegs for receiving a calendar pad, thereby permitting the user to reuse the display article year after year.

Calendars that display one month per page are disclosed in U.S. Pat. No. 5,316,342, issued to Almo on May 31, 1994 (calendar sheet is divided into an upper half and a lower half, the lower half displays a pre-designated month and the upper half is blank to display art work) and U.S. Pat. No. 1,222,612, issued to Evans on Apr. 17, 1917 (twelve-sheet memorandum calendar providing space to record information).

Calendars designed to fit on one continuous sheet and that can be rolled to expose current or future dates are disclosed in U.S. Pat. No. 1,710,434, issued to Shedo on Apr. 23, 1929 (a rolling calendar, which has a stationary portion to display advertisements or other data); and U.S. Pat. No. 4,345,392 issued to Cornell on Aug. 24, 1982.

Still other calendars are described in U.S. Pat. No. 4,720,123, issued to Chelius on Jan. 19, 1988 (a year-specific calendar displaying twelve months divided between two columns and a third column that lists important events and holidays) and U.S. Pat. No. 5,431,450, issued to Coleman on Jul. 11, 1995 (medication management calendar-chart that uses a dry-erase board).

None of the above inventions and patents, taken either singly or in combination, is seen to describe the instant invention as claimed. Thus, a birthday calendar solving the aforementioned problems is desired.

SUMMARY OF THE INVENTION

The birthday calendar is a dual monthly calendar and twelve-month chart. The calendar is perpetual in that it is not designated for any particular year or month. The monthly calendar is made of a dry-erase board displaying a month grid that is filled in with erasable ink for any particular month. As an alternative to the dry-erase board, the monthly calendar portion of the birthday calendar may utilize a tear-away calendar or a spiral calendar that can be attached and removed from the monthly calendar section by attachment members.

The chart is a grid used to permanently record and display birth dates and other annual dates, such as anniversaries and holidays. It is constructed of paper material and displays columns intersected by rows. The columns are grouped in twelve sets of two, with a month column adjacent to a year column. The rows display the dates of each month down the left side of the chart, numbered from 1–31. An event is recorded in the chart by writing the event's name in the appropriate month and date space, and the year in the adjacent year space.

BRIEF DESCRIPTION OF THE DRAWINGS

FIG. 4A is a fragmented, front view of the birthday calendar according to the present invention showing the top third of the calendar with important dates filled in.

FIG. 4B is a continuation of FIG. 4A, showing the middle third of the birthday calendar with important dates filled in.

FIG. 4C is a continuation of FIG. 4B, showing the bottom third of the birthday calendar with the dates filled in for a particular month and names of people celebrating birthdays filled in.

Similar reference characters denote corresponding features consistently throughout the attached drawings.

DETAILED DESCRIPTION OF THE PREFERRED EMBODIMENTS

Figure 1:
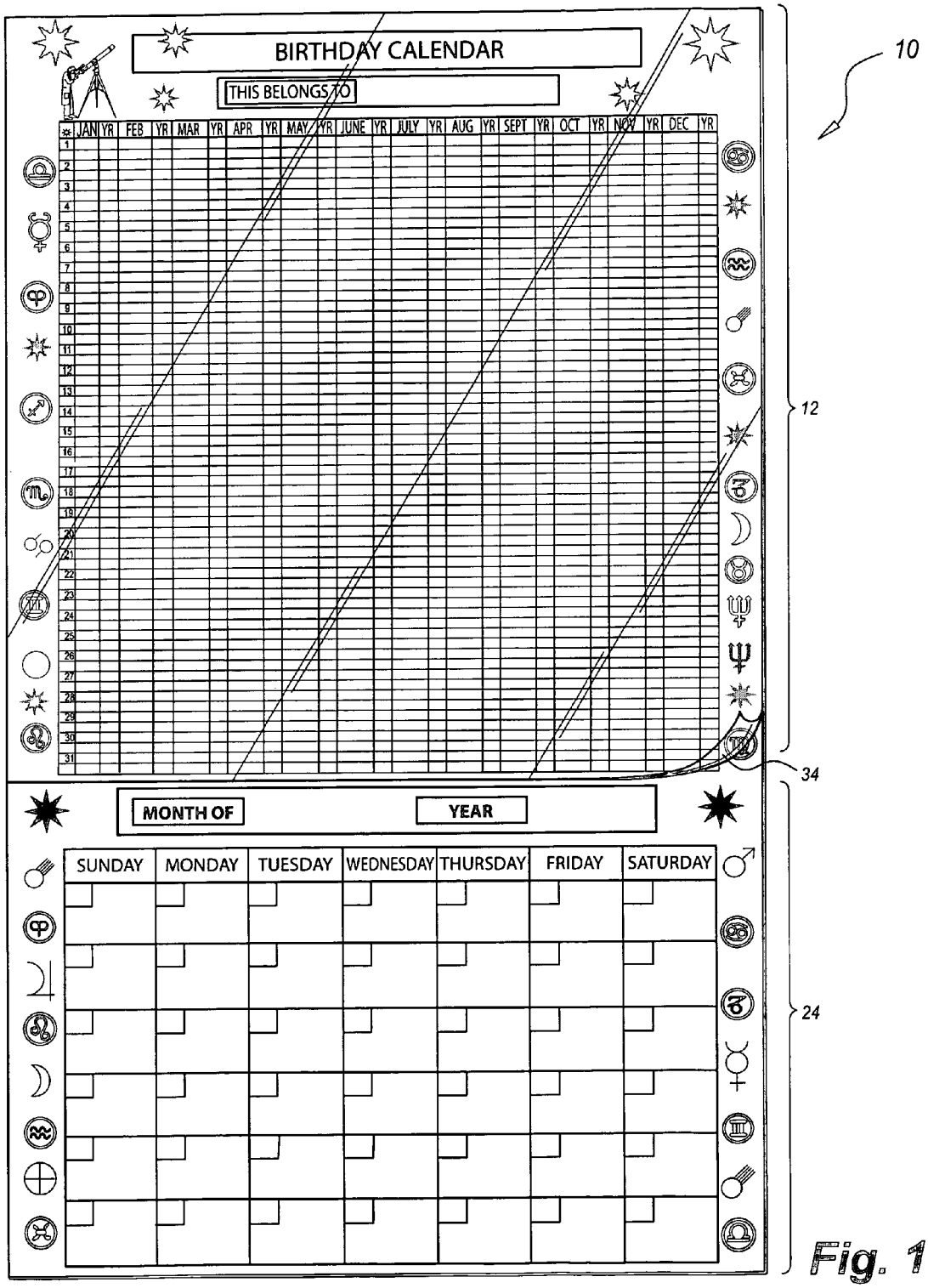
FIG. 1 is front view of the birthday calendar according to the present invention.

The present invention is a birthday calendar, designated generally as 10 in FIG. 1. The calendar 10 has two sections, a twelve-month (or annual) chart 12 and a monthly calendar 24. The chart 12 is made of construction paper, paperboard, cardboard or similar paper material that is capable of recording indelible ink, either by imprinting or written by pen, to provide a permanent record of events. The monthly calendar 24 is a dry-erase board, or similar material, that is marked by erasable ink. If desired, the monthly calendar 24 may have an anchoring piece to hold a dry-erase marker to it.

It will be understood that the term "dry-erase board" embraces any material which permits permit imprinting of the grid and indicia indicating the day of the week thereon, but provides an erasable surface for marking memoranda or notes in or over the grid spaces. Thus, the monthly calendar may be made from relatively rigid "whiteboard" or blackboard, or from a flexible material, such as paper covered by a thin sheet of flexible transparent plastic capable of accepting writing from erasable marking pens. The chart 12 and the monthly calendar 24 may be joined together in any conventional manner, e.g., by joining the two sections together by a cloth or nylon strap secured to each section, by adhering the two sections to a common backing material, by making the chart 12 and the monthly calendar on the same piece of paper or cardboard and covering them both with the same sheet or film of plastic.

The calendar 10 is rectangular in shape, preferably with the chart 12 disposed above the monthly calendar 24 or the chart 12 being disposed below the monthly calendar 24. However the calendar can take a side-by-side arrangement in which the chart 12 is adjacent to, but integral with, the monthly calendar 24, if desired. The representative dimensions of the birthday calendar are about between 31⅝ inches long and between 16 9/16 inches wide. The calendar 10 may be about as thick as a piece of paper, so that the calendar 10 can be rolled up like a poster, or the calendar 10 may be stiff and rigid. The recited dimensions, however, need not limit the present invention. Translucent plastic 34, such as Plexiglas® (a trademark of Rohm & Haas Co.), or glass is placed over the chart 12 to protect the chart 12 from water, smoke, grease and other elements. The calendar 10 can be hung on a wall by a picture hanger or other means.

Figure 2:
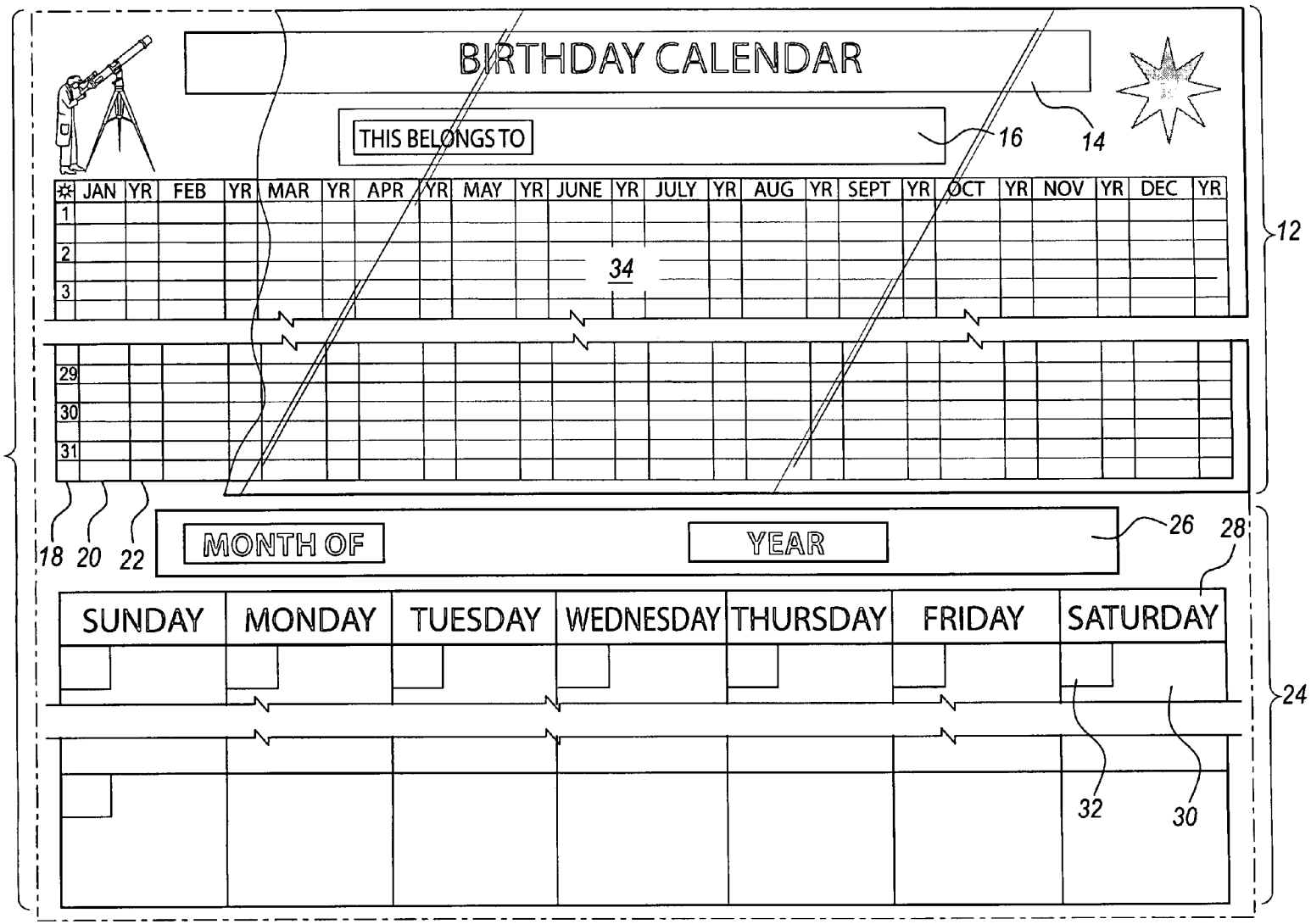
FIG. 2 is a fragmented, detail view of the birthday calendar according to the present invention.

Referring to FIG. 2, the chart 12 has two heading sections: a title section 14 and a name section 16. The title section 14 displays the words "BIRTHDAY CALENDAR"; the name section 16 displays the words "THIS CALENDAR BELONGS TO" and provides space to fill in the name of the individual to whom the calendar belongs. The chart 12 is a place to permanently record birthdays for friends, family members, celebrities or even pets, as well as to record holidays and anniversaries. As substitute titles, the title section 14 can be designated "FAMILY TREE BIRTHDAY CALENDAR", if used to record the birthdays of family members; "FRIENDS BIRTHDAY CALENDAR", if used to record the birthdays of friends; or simply "CALENDAR" if used to record dates for a combination of events or groups of people as mentioned above.

The chart 12 is a grid formed by twenty-five columns that are intersected by at least thirty-two rows. The first column of chart 12 is a date column 18 that is consecutively numbered 1–31 vertically down the left side of the chart 12 in order to display dates for all twelve months. The first space in the date column 18 is also the first space in the topmost row, and is marked with a marker, void of any information. The next twenty-four columns are divided into twelve sets of two columns each, the first column 20 being a month-indicating column 20 and the adjacent column 22 being a year-indicating column 22. In the topmost row, the month-indicating columns 20 are labeled with indicia consecutively from January to December, either abbreviated or fully written out; the adjacent year-indicating column 22 is labeled as "year" or "yr". The twelve sets of month-indicating spaces 20 and year-indicating spaces 22 in the topmost row are title headers for each of the twenty-four columns. In the preferred embodiment, the date column 18 has two rows per date, see FIGS. 1, 2, 4A and 4B, leaving space for two entries per date.

Still referring to FIG. 2, the monthly calendar 24 has a month and year title section 26 that precedes the month grid. The month and year title section 26 allows a user to temporarily write-in the particular month and year that the monthly calendar 24 is being used for. The month grid of monthly calendar 24 is formed by seven rows divided into seven columns. The first row 28 contains indicia that indicate the seven days of the week in seven respective spaces. The subsequent six rows have seven blank spaces 30 each to form a total of forty-two blank spaces in the monthly calendar 24. The forty-two blank spaces 30 provide room to write information, if desired. Each of the forty-two blank spaces 30 has smaller blank date spaces 32 defined therein to provide an area to write down the dates of the month. The date spaces 32 are preferably located in the top left corner of each of the forty-two blank spaces 30; however, the location of date spaces 32 is not critical, and the date spaces 32 can be positioned elsewhere as well. The dimensions of the blank spaces 30 are preferably about 15/16 inches long by 11/16 inches wide and the date spaces 32 are about ½ inch long by 9/16 inches wide. After the user fills in the monthly calendar 24 for a particular month the entire monthly calendar 24 is erased or wiped clean and the user fills in the dates for the subsequent month in the date spaces 32 and the year and the name of the month in the month and year title section 26. Advantageously, by providing for six rows in the monthly calendar 24, the grid has enough spaces to accommodate months with thirty-one days, even if the first day falls on a Friday or Saturday so that the thirty-one days spreads across at least a part of six weeks.

Figure 3:
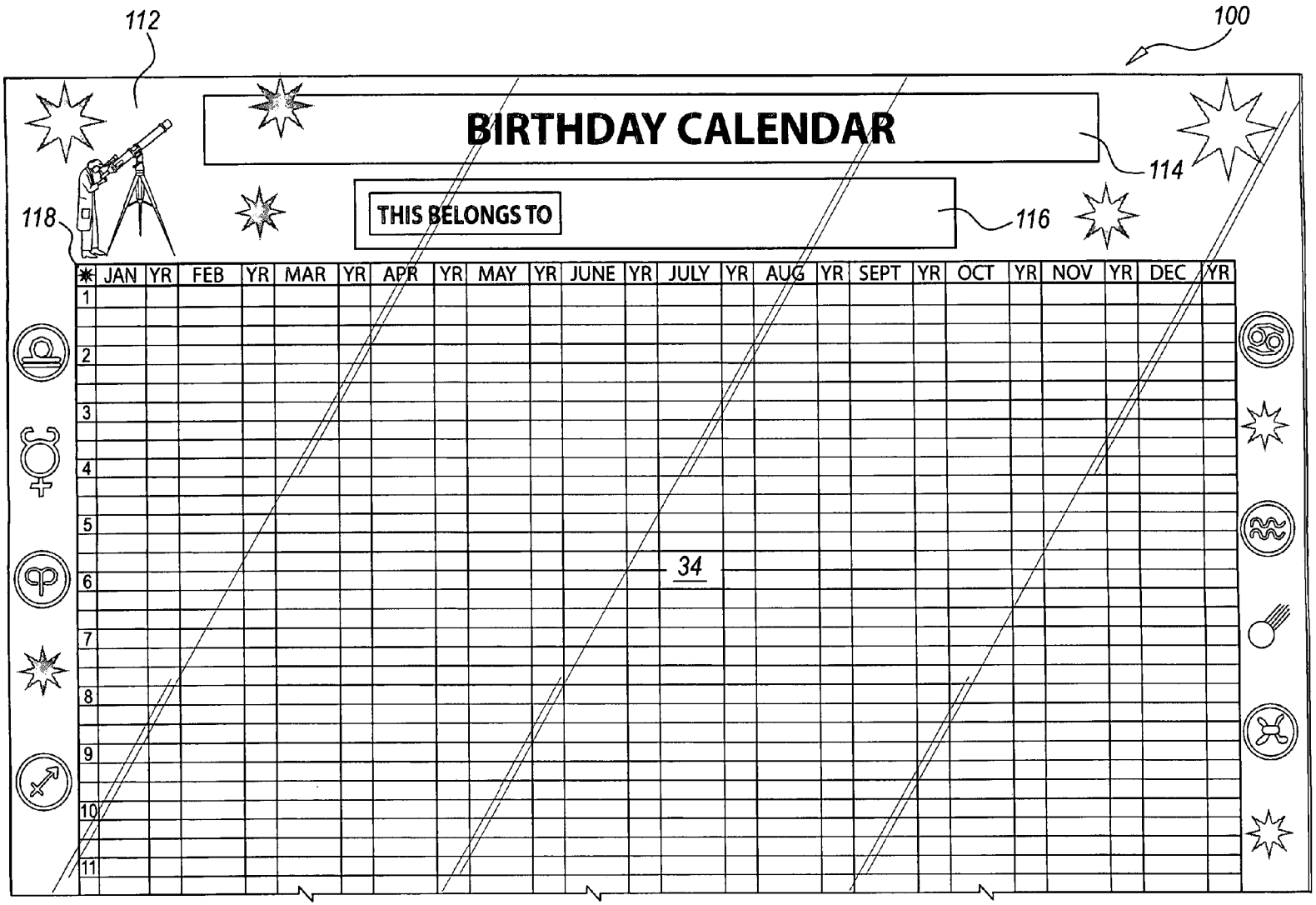
FIG. 3 is a partial view of an alternative embodiment of the birthday calendar showing only the twelve-month chart.

FIG. 3 shows an alternative embodiment of the present invention 100 having three rows per date in chart 112. The chart 112 is used in conjunction with the monthly calendar 24 as seen in FIGS. 1, 2 and FIG. 4C. It should also be mentioned that the rows per date could be just one row per date or more than three rows per date. The alternative embodiment 100, similar to the preferred embodiment 10, has a title section 114 to indicate the calendar type, a name section 116 to indicate to whom the calendar belongs, and the chart 112 is protected by translucent plastic 34. Indicia indicating the dates are formed in date column 118, and the three rows per date provide space to list names for birthdays that fall on the same date.

Figure 4A:
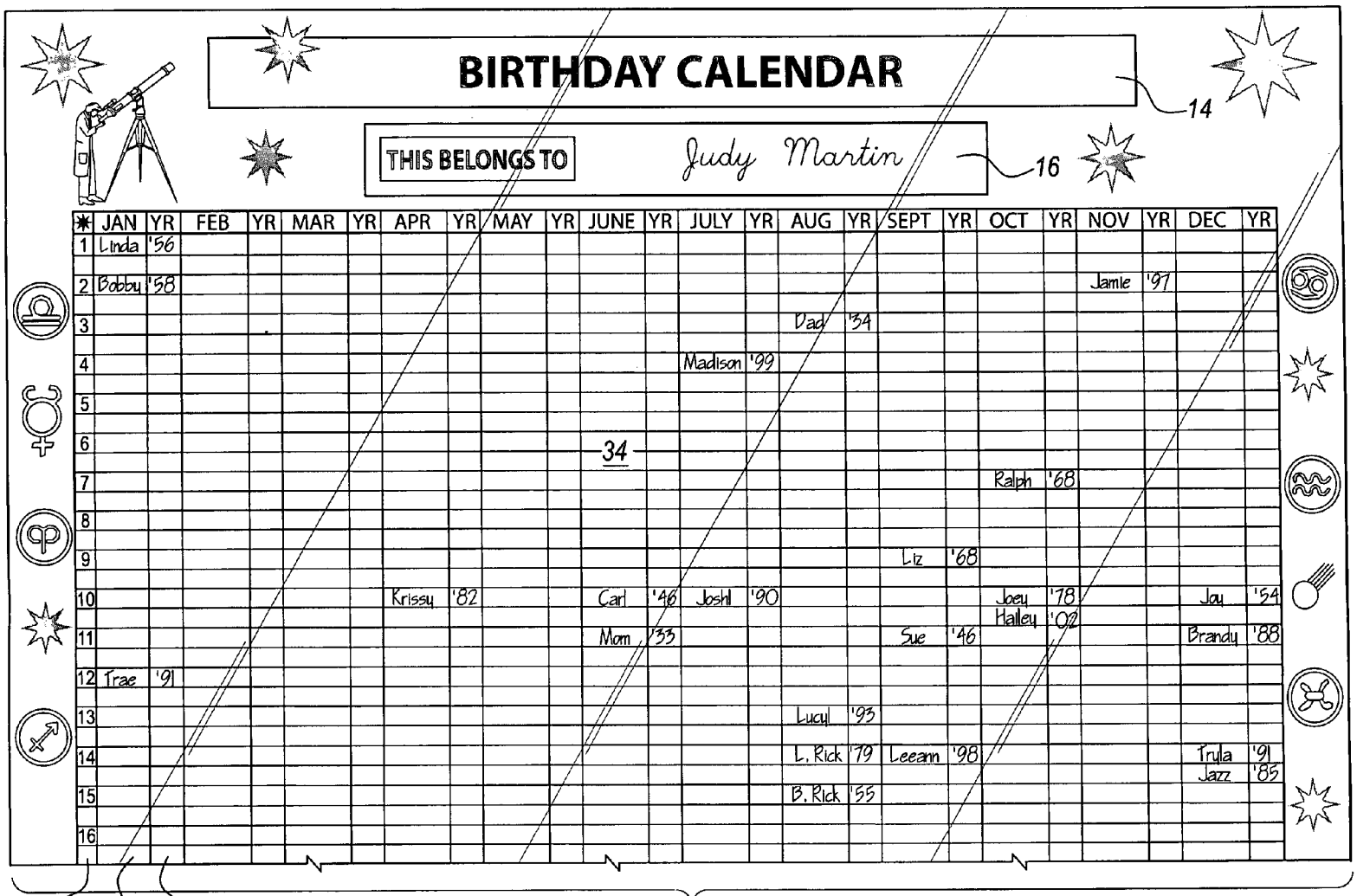
Figure 4B:
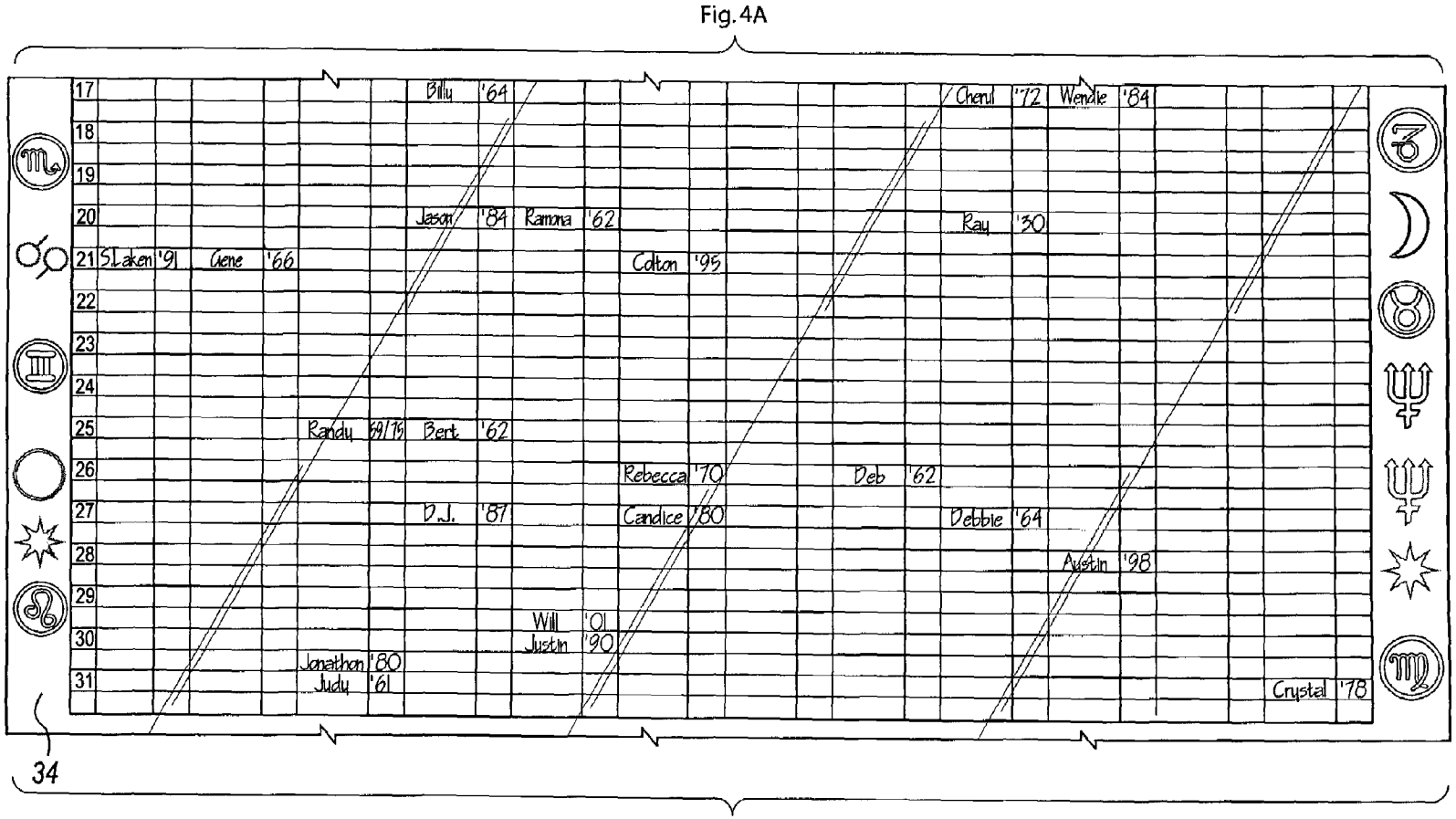
Figure 4C:
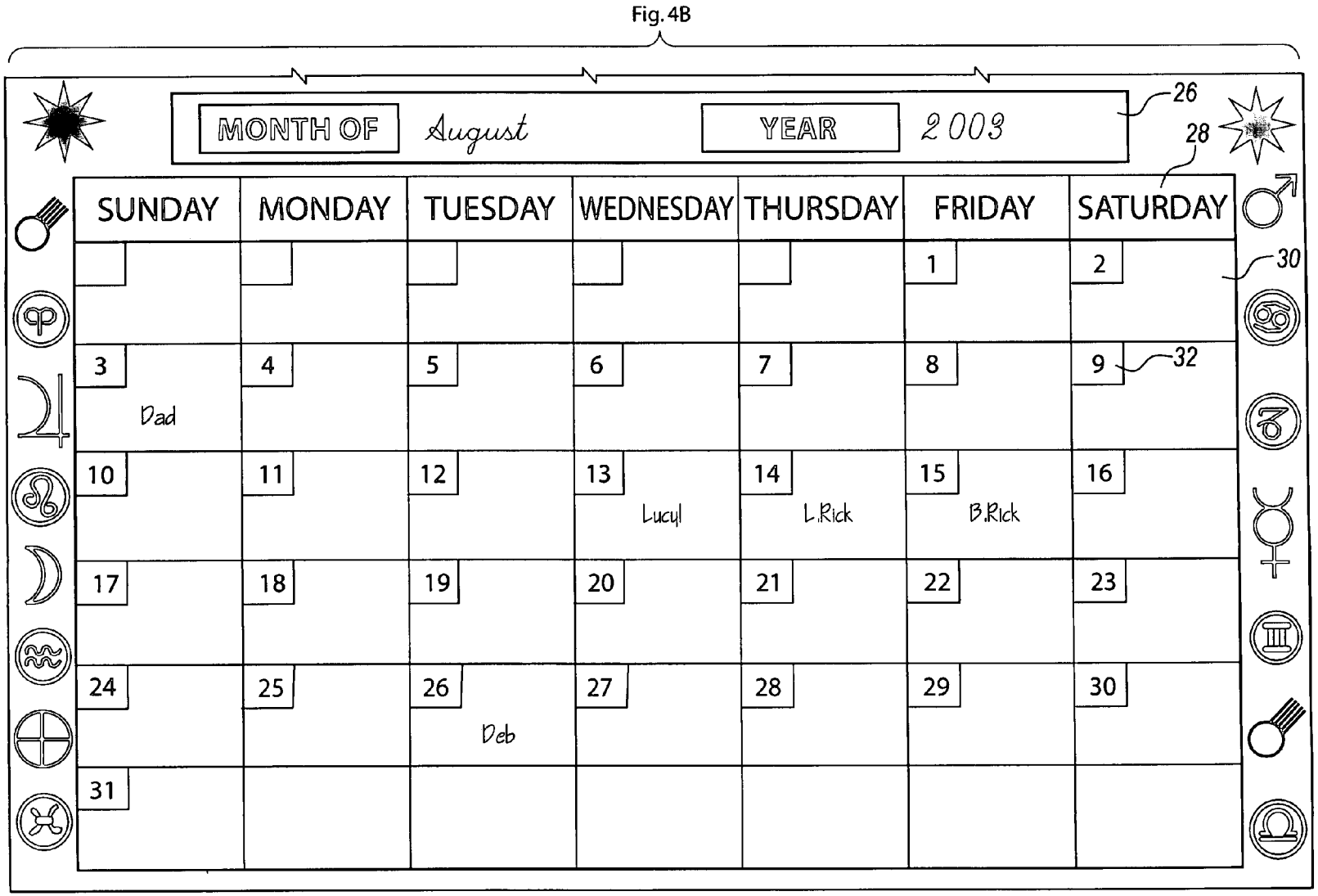

For illustrative purposes the calendar 10 is prepared for an exemplary individual, as shown in FIGS. 4A–4C. A number of birthdays are written into chart 12, FIGS. 4A–4B, by writing in the person's birth date in the appropriate date row and month column space and the year of the person's birth in the adjacent year space. For example, for a person named Lucyl born on Aug. 13, 1993, the owner of the calendar would go down the month column for August and across the date row for date number 13 and write in Lucyl's name in the appropriate space. Adjacent to that, the user would write in '93 or 1993 to indicate Lucyl's birth year in the year column.

In FIG. 4C, the monthly calendar 24 is dated for the month of August in the year 2003, as indicated in the date spaces 32 and month and year title section 26. As shown in the Figure, the monthly calendar 24 can also be used to insert memos or write in the names of people celebrating birthdays in the indicated months. Thus according to what is recorded in chart 12 in FIGS. 4A and 4B, "Dad" is written in the blank space 30 under, August 3 and "Deb" is written in the blank space 30 under August 26. By inserting the names in the monthly calendar 24 the user is able to see what day of the week the birthday will fall on.

Hence the birthday calendar 10 of the present invention provides a convenient and easy-to-use reference for remembering important dates and anniversaries.

Figure 5A:
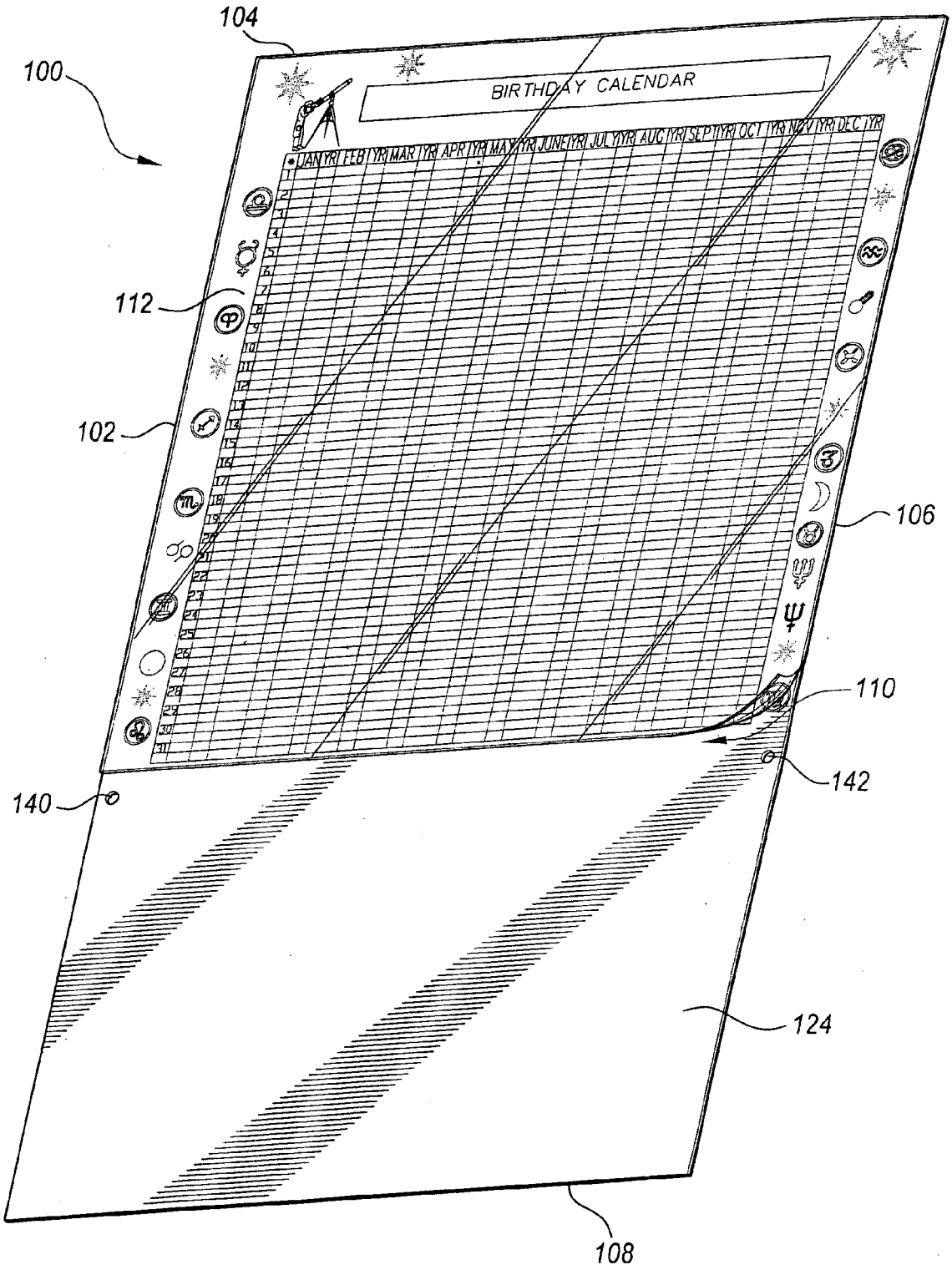
FIG. 5A is a front view of another alternative embodiment of the birthday calendar of the present invention with the monthly calendar omitted.

FIG. 5A shows an alternative embodiment of a birthday calendar according to the present invention, designated as 100, which is mounted on a sturdy material, such as a rigid, solid board, that serves as a common backing with a twelve-month chart section for attaching a twelve-month (or annual) chart 112 and a monthly calendar section 124 for mounting a monthly calendar. Alternatively, the calendar 100 can be made by individually attaching the sections 112, 124 on solid boards and then connecting the boards together.

The calendar 100 has a first side edge 102, a top edge 104, a second side edge 106, a bottom edge 108 and a shared portion 110. The shared portion 110 is the juncture where the chart 112 and the monthly calendar 124 sections are juxtaposed and meet. The shared portion 110 therefore comprises the bottom end of chart section 112 and the top end of monthly calendar section 124. The chart is similar to the chart 12 of the preferred embodiment.

Figure 5B:
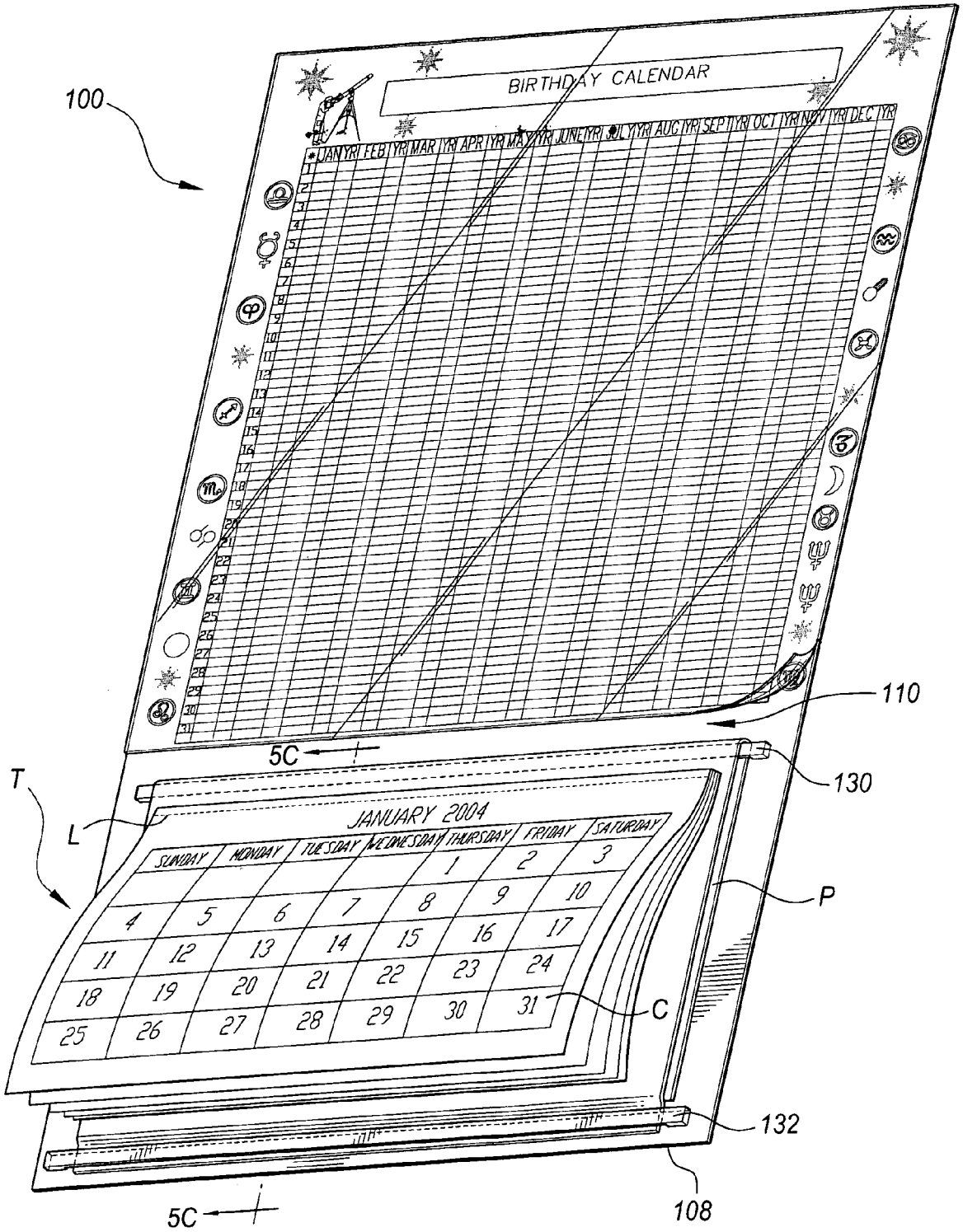
FIG. 5B is a front view of the birthday calendar of FIG. 5A B with the monthly calendar attached.
Figure 5C:
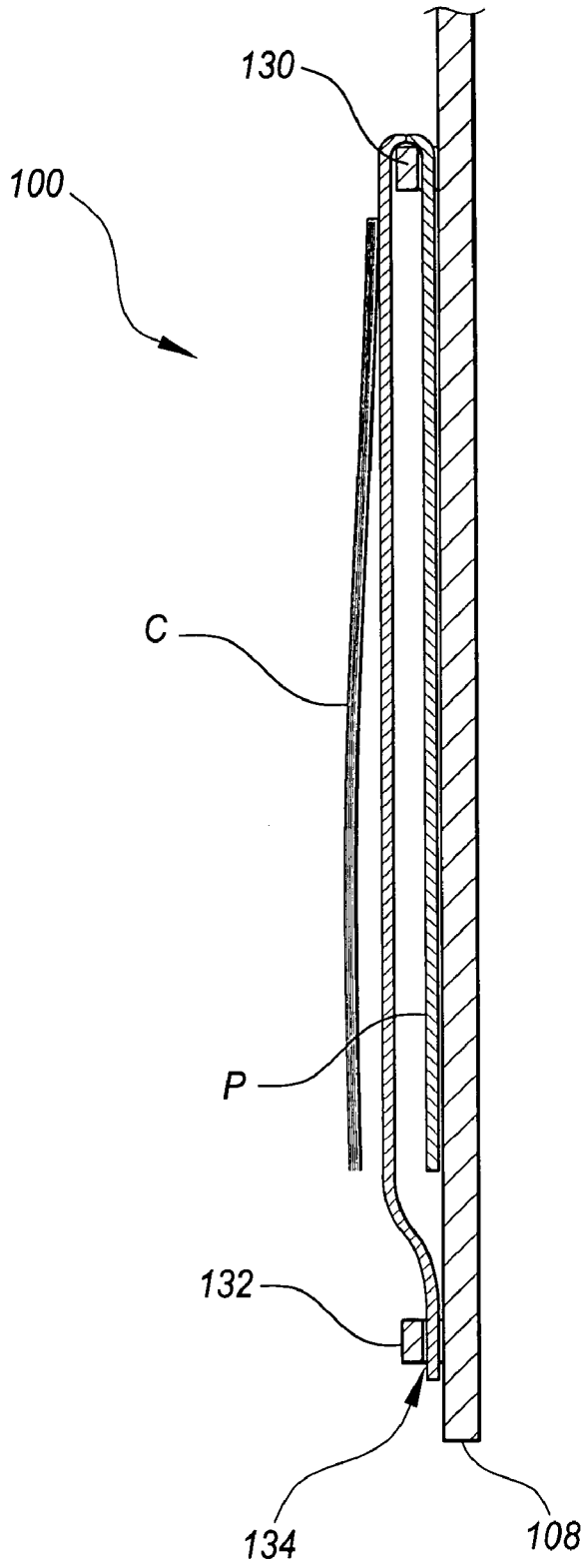
FIG. 5C is a section view along lines 5C—5C of FIG. 5B.
Figure 5D:
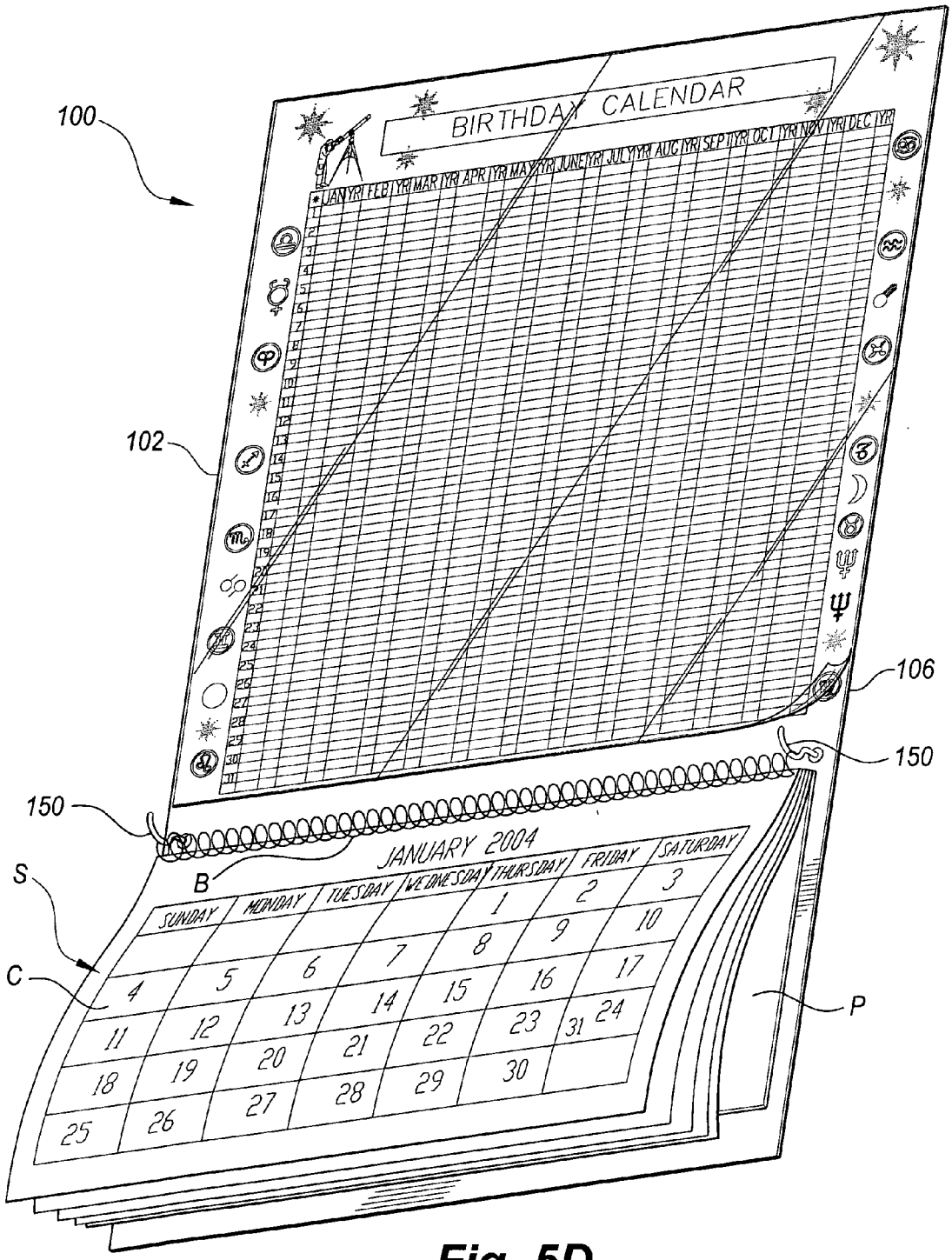
FIG. 5D is a front view of the embodiment of FIGS. 5A–5C, showing an alternative manner of attaching the monthly calendar.

The monthly calendar, unlike the monthly calendar 24 in the preferred embodiment, may or may not be made with a dry erase board. The monthly calendar 124, however, still will display a month of a year by being constructed to accommodate an optional twelve-month, single-use calendar T, S by attachment accessories, as shown in FIGS. 5B–5D. Therefore, if the monthly calendar section 124 is made from a dry-erase board, then the user has the option of using either the blank dry erase board or the single-use calendar T, S in the calendar 100.

Single-use calendars include, among others, tear-away calendars T and spiral bound calendars S. Normally these single-use calendars T, S are arranged on a vertical sheet which is divided in half, horizontally, with a calendar indicia C portion disposed below a graphic portion P. In order to reveal the next month, when a previous month expires, the expired calendar indicia C sheet may be either torn along a perforated line L, as with a tear-away calendar T, or turned to reveal the new month sheet, as with a spiral bound S calendar.

As mentioned above, the monthly calendar section 124 is made to support a variety of attachment members for accommodating single-use calendars T, S, regardless of whether or not the monthly calendar 124 section is constructed to display a dry erase board. The attachment members may be removably attachable to the monthly calendar section 124, permitting the user to choose the type of attachment members to use with the calendar 100. Such attachment members include, but are not limited to, brackets 130, 132, rods, hooks 150, wires, clips, tacks and pins. Alternatively, glue or other tacky material can be used to attach the single-use calendars T. S to the monthly calendar section 124. Holes 140, 142 may also be defined in the monthly calendar section 124 to permit the user to string wire through the holes and create a line to hang a single-use calendar T, S.

FIG. 5B shows calendar 100 having two brackets 130, 132, however, the calendar 100 may only have one bracket 130 or more than one bracket 130, 132. In the two bracket 130, 132 configuration, one bracket 130 is disposed just below chart section 112 at the shared portion 110 of the calendar 100, and the other bracket 132 is disposed near the bottom edge 108 of the calendar 100.

FIG. 5C shows the side view of the monthly calendar section 124 of FIG. 5B. In use, the user slides the graphic portion P of the single-use calendar T down behind the bracket 130, permitting the single-use calendar T to hang and display the calendar indicia portion C. The lower bracket 132 serves to restrain and support the lower end of the single-use calendar T.

The brackets 130, 132 are disposed horizontally on the monthly calendar section 124 to support horizontally bound single-use calendars T, but brackets 130, 132, may be disposed in any other position and location. For example, if a single use calendar T is vertically bound, then the brackets may be disposed vertically on the monthly calendar section 124.

Hooks 150 may be another accessory that is utilized with the monthly calendar section 124. The hooks 150 may be inserted through holes 140, 142 to support a single-use calendar S, as shown in FIG. 5D. Calendar 100 is shown possessing two holes 140, 142, however, the calendar 100 can have only one hole or more than one hole 140, 142. In the two hole 140, 142 configuration, each hole 140, 142 is disposed just below the chart section 112 at the shared portion 110 of the calendar 100. One hole 140 is located at side edge 102 and the other hole 142 is located at side edge 106. The hooks 150 are inserted into the holes 140, 142 and permit a spiral bound calendar S to hang by having the hooks 150 loop through a spiral binding B of the spiral bound calendar S. Although hooks 150 have been described for use with the holes 140, 142, the hooks 150 may also be tacked into the monthly calendar section 124, thereby forgoing the need for holes 140, 142.

The brackets 130, 132, hooks 150 and holes 140, 142 may be located in positions other than the ones mentioned above. For example, if only one hook 150 or one hole 140 and hook 150 is used with the calendar 100, then it may be located just below the shared portion 110 of the calendar 100, half way between side edges 102 and 106.

As with the preferred embodiment, the birthday calendar 100 may be arranged in any order, such as a side-by-side arrangement, or with monthly calendar section 124 disposed above chart section 112. Also, it is foreseeable that other sorts of single-use calendars may be utilized with the birthday calendar 100. By using a single-use calendar T, S with the birthday calendar 100, the user would not have to write in the days of the month or check to see how many days are within each specific month and what day each month begins on. The birthday calendar 100 allows the user to use the chart 112 with single-uses calendars T, S that they already possess.

It is to be understood that the present invention is not limited to the embodiments described above, but encompasses any and all embodiments within the scope of the following claims.

I claim:

1. A birthday calendar for recording birthdays and other annual dates, comprising:

a rigid, unitary backing, said backing defining a first section and a second section;

a single sheet twelve-month chart disposed on the first section of said backing, said chart having vertical and horizontal parallel arranged intersecting lines imprinted thereon defining a plurality of memorandum spaces for recording a date of an annually recurring event;

a transparent protective cover removably disposed over said chart;

a monthly calendar disposed on the second section of said backing, wherein said monthly calendar is made from whiteboard; and a plurality of attachment members for removably attaching said monthly calendar to the backing;

whereby the chart provides a record of annually recurring events selectively recorded thereon by an user and the monthly calendar displays the days of the month, wherein both the chart and the monthly calendar are simultaneously visible.

2. The birthday calendar according to claim 1, wherein said chart is formed by a chart grid having twenty-five columns intersected by a plurality of rows in order to define the plurality of memorandum spaces.

3. The birthday calendar according to claim 1, wherein said protective cover is made from glass.

4. The birthday calendar according to claim 1, wherein said protective cover is made from plastic.

5. The birthday calendar according to claim 1, wherein said chart is made from a material having a surface capable of retaining indelible ink applied thereto.

6. The birthday calendar according to claim 1, wherein said monthly calendar has vertical and horizontal parallel arranged intersecting lines imprinted thereon defining a monthly calendar grid having an erasable surface overlying memorandum spaces defined by the grid in order to reuse the grid from month-to-month.

7. The birthday calendar according to claim 1, wherein said monthly calendar further comprises erasable spaces disposed adjacent the monthly calendar grid sized and dimensioned for temporarily designating a current month and year.

8. The birthday calendar according to claim 1, wherein said chart further comprises indicia imprinted adjacent said memorandum spaces for designating a title and owner of the birthday calendar.

9. The birthday calendar according to claim 1, wherein said attachment members are brackets.

10. The birthday calendar according to claim 1, wherein said attachment members are hooks.

11. The birthday calendar according to claim 2, wherein columns two through twenty-five of the chart grid are grouped in pairs of adjacent columns, each pair having a first column corresponding to a month and a second column corresponding to a year.

12. The birthday calendar according to claim 11, wherein the chart grid the plurality of rows includes a top row, the first column of each pair adjacent columns in the top row having indicia therein designating months from January through December displayed therein, the second column of each adjacent pair in the top row having indicia representing the word "year" displayed therein, whereby the top row defines a horizontal legend for the chart grid.

13. The birthday calendar according to claim 12, wherein said twenty-five columns includes a first column, the first column having indicia displayed therein representing numbers one through thirty-one in separate rows, whereby the first column defines a vertical legend for the chart grid, an intersection of one of the rows with one of the grouped pairs of adjacent columns defining memorandum space for recording an event and a year in which the event occurred in order to permanently record the month, day and year of the event.

14. The birthday calendar according to claim 13, wherein said chart grid further comprises at least one blank row disposed between each of the rows displaying the indicia representing numbers one through thirty-one, whereby multiple events occurring on identical months and days may be permanently recorded.

15. The birthday calendar according to claim 6, wherein said monthly calendar grid has indicia defining a grid having seven rows and seven columns, the seven rows including a top row displaying indicia representing days of a week from Sunday through Saturday, the top row defining a horizontal legend for said monthly calendar grid.

16. The birthday calendar according to claim 6, wherein said monthly calendar is made from paper having an erasable plastic cover disposed thereon.

17. The birthday calendar according to claim 15, wherein said monthly calendar grid further comprises a blank date space disposed in each of the memorandum spaces defined by said rows and columns below the top row, the blank space date being sized and dimensioned for writing a number from one through thirty-one therein representing a day of a month.

* * * * *